United States Patent [19]

Atkins, Sr.

[11] 4,245,592

[45] Jan. 20, 1981

[54] CONTROLLED FLOW PURGE SYSTEM AND APPARATUS

[75] Inventor: Walter J. Atkins, Sr., Wayne, Mich.

[73] Assignee: Chrysler Corporation, Highland Park, Mich.

[21] Appl. No.: 41,368

[22] Filed: May 22, 1979

[51] Int. Cl.[3] ..... F02M 7/00

[52] U.S. Cl. ..... 123/572; 123/520; 137/543.17

[58] Field of Search ..... 123/136, 119 B; 137/543.17, 526

[56] References Cited

U.S. PATENT DOCUMENTS

| | | | |
|---|---|---|---|
| 3,554,175 | 1/1971 | Sarto | 123/136 |
| 3,661,128 | 5/1972 | Eshelman | 123/119 B |
| 3,678,910 | 7/1972 | Marlett | 123/119 B |
| 3,779,224 | 12/1973 | Tagawa et al. | 123/136 |
| 4,026,258 | 5/1977 | Ino et al. | 123/136 |
| 4,066,055 | 1/1978 | Hager | 123/119 B |
| 4,090,477 | 5/1978 | Gockel | 123/119 B |

*Primary Examiner*—Ira S. Lazarus
*Assistant Examiner*—Magdalen Moy
*Attorney, Agent, or Firm*—Newtson & Dundas

[57] ABSTRACT

With an engine having a crankcase, a suction or vacuum producing air induction means and a hydrocarbon vapor storage container, a system for purging both the storage container and the engine crankcase at varying rates according to engine operation, including a first passage means between the crankcase and the air induction means and a second passage means between the storage container and the crankcase. In the second passage means, a multi-position valving member is moved in response to changing vacuum levels in the crankcase and in cooperative action with a flow orifice or opening to produce desired variable flow rate through the storage container.

5 Claims, 7 Drawing Figures

FIG. 3.
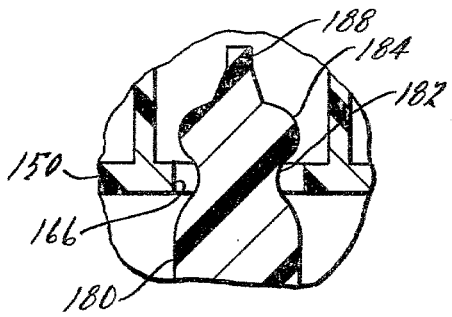
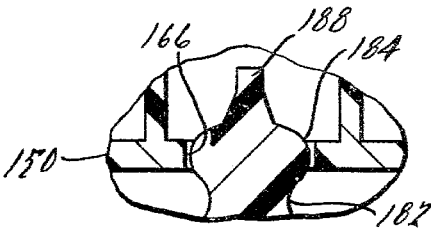
FIG. 4.
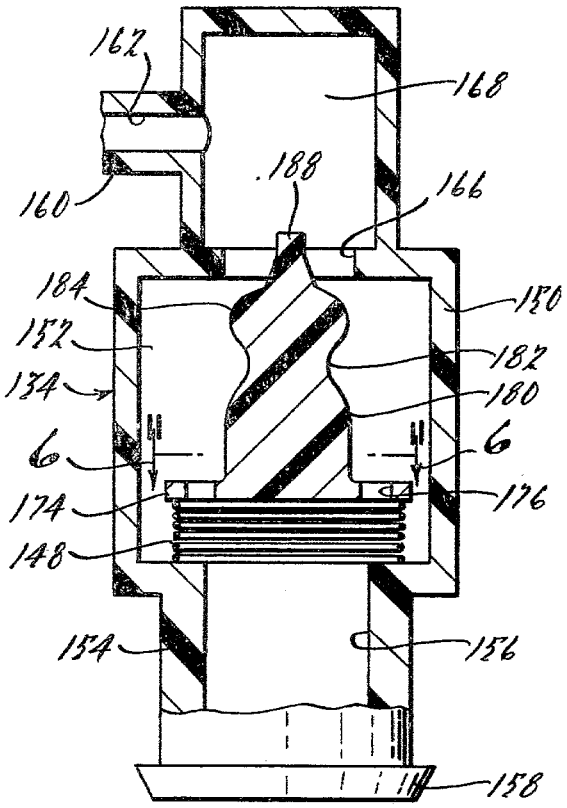
FIG. 5.
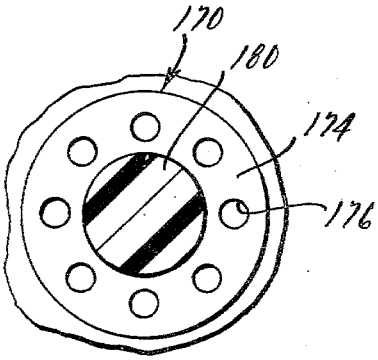
FIG. 6.
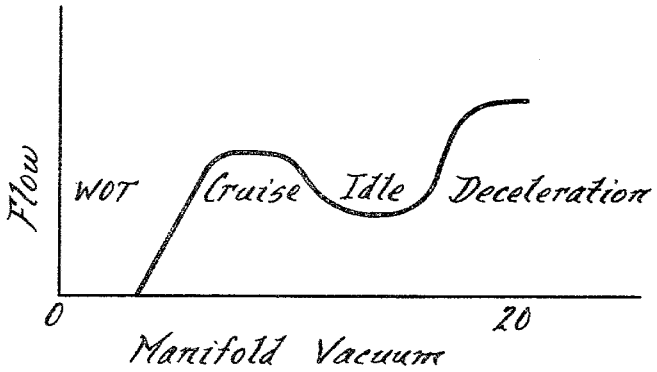
FIG. 7.

CONTROLLED FLOW PURGE SYSTEM AND APPARATUS

This invention relates to an engine hydrocarbon control system for fluidly connecting the crankcase and a hydrocarbon vapor storage container to the engine air induction means thereby producing a predetermined desired flow rate through the storage container and the crankcase which changes corresponding to changing operating modes of the engine.

For the past several years, automobile engines have included means fluidly connected to the engine carburetor to evacuate the crankcase of hydrocarbon vapors and thus withdraw lubricant and fuel vapors therefrom. Commonly, a breather cap device has been provided to permit flow of air into the crankcase. The air then flows through a PCV (positive crankcase ventilation) valve to the carburetor. The PCV is basically a check valve which prevents reverse flow from the carburetor back into the crankcase. This system works well to purge the fuel and lubricant vapors from the engine. However, the addition of supplemental air to the carburetor may have an undesirable effect on engine operation, particularly during engine idling. Often these additional quantities of air added to the manifold are sufficient during an idle mode of operation to adversely affect the engine operation by excessively leaning the air-fuel mixture. Nor is a continuous high flow rate through the crankcase necessary.

In addition to the aforementioned PCV system, a hydrocarbon vapor storage canister is commonly provided to temporarily store hydrocarbon vapors emitted from the fuel tank or from the float bowl of a carburetor. The canister interior contains activated carbon having a finite storage capacity. Therefore, it is necessary to periodically purge the canister by drawing air through it. Since an automobile engine operates most often in a cruise mode of operation, a large percentage of the crankcase purging as well as the rejuvenation of the storage canister should occur during this operative mode. Another desirable time to rejuvenate the canister occurs when the vehicle is decelerating. In this deceleration mode, the carburetor throttle plate is in a closed position and consequently manifold vacuum is at a particularly high level. A large flow of air can be pulled through the crankcase and the storage canister during a deceleration mode without adversely affecting engine operation.

To control purge flow according to the aforesaid desired conditions, an automatic flow control valve is provided. It substantially prevents flow during a wide open throttle mode of operation and it provides only a modest flow during an idling mode. During these modes, the vehicle requires the most efficient operation of the engine. During cruise and deceleration modes however, the flow through the canister and the crankcase is substantially increased since slight engine inefficiency may be tolerated under these conditions. The flow control valve is located between the outlet of the hydrocarbon vapor storage canister and the engine. A flow opening or orifice is provided within the valve through which portions of a valving member extends. The valving member is normally moved to a closed position by yieldable means such as a coil spring. During wide open throttle operation of the engine, the crankcase vacuum level is at its lowest level and thereby the movable valve member is held in the closed position by the spring. In the closed position, substantially all flow through the crankcase or the canister is prevented. As the engine attains a cruise operational mode the throttle blade of the carburetor moves to a mid-position and the vacuum pressure in the carburetor is communicated to the crankcase and hence to a surface of the valve member. At cruise the vacuum is greater than at WOT and therefore the valving member is moved against the spring so that a small dimensioned contour of the valve member is brought within or across the orifice opening. This facilitates relatively large flow of air therethrough and through the canister. During an idle mode, it is undesirable to permit such a large flow of air to the manifold since this may undesirably change the air-fuel mixture and produce roughness. Therefore, an increased vacuum pressure level associated with an idle mode further moves the valve member against the spring so that a larger dimensioned portion is placed across the opening. This greatly decreases the air flow from and through the canister and to the manifold. The highest vacuum pressure levels are obtained when the engine is decelerating. The high vacuum then moves the valve member further against the spring thereby positioning a small dimensioned portion of the valve in the opening. Resultantly a maximum flow of air passes through the opening and provides maximum purging of the storage canister and crankcase.

In view of the previous remarks, it can be understood that continuous purging of the canister may have adverse affects on engine operation under certain operating conditions. Particularly, it is desirable to decrease the purge flow during engine idle and W.O.T. conditions. It is highly desirable to provide for a much greater purge flow under deceleration conditions of the engine when maximum flow is possible without adversely affecting engine operation. Accordingly, it is an object of the present invention to provide an engine crankcase and canister purge system with greatest air flow during the deceleration mode and substantial flow during a cruise mode. The flow is substantially decreased during engine idling mostly blocked at wide open throttle. A further object of the invention is to provide a vapor storage and crankcase purging system which utilizes an automatic air flow control responsive to engine vacuum conditions to provide maximum purge flow under an engine deceleration condition, decreased purge flow during a cruise condition, a substantially reduced flow during idling and substantially zero flow during wide open throttle operation.

Other objects and advantages of the invention will be more readily apparent from a reading of the following detailed description of one inventive embodiment, reference being had to the accompanying drawings in which the embodiment is illustrated.

IN THE DRAWINGS

FIGS. 2, 3, 4 and 5 are sectioned views of the control valve in four operative positions;

FIG. 6 is a view taken along section lines 6—6 in FIG. 5 and looking in the direction of the arrows; and FIG. 7 is a plot of the air flow through the control valve in response to varying manifold vacuum.

Figure 1:
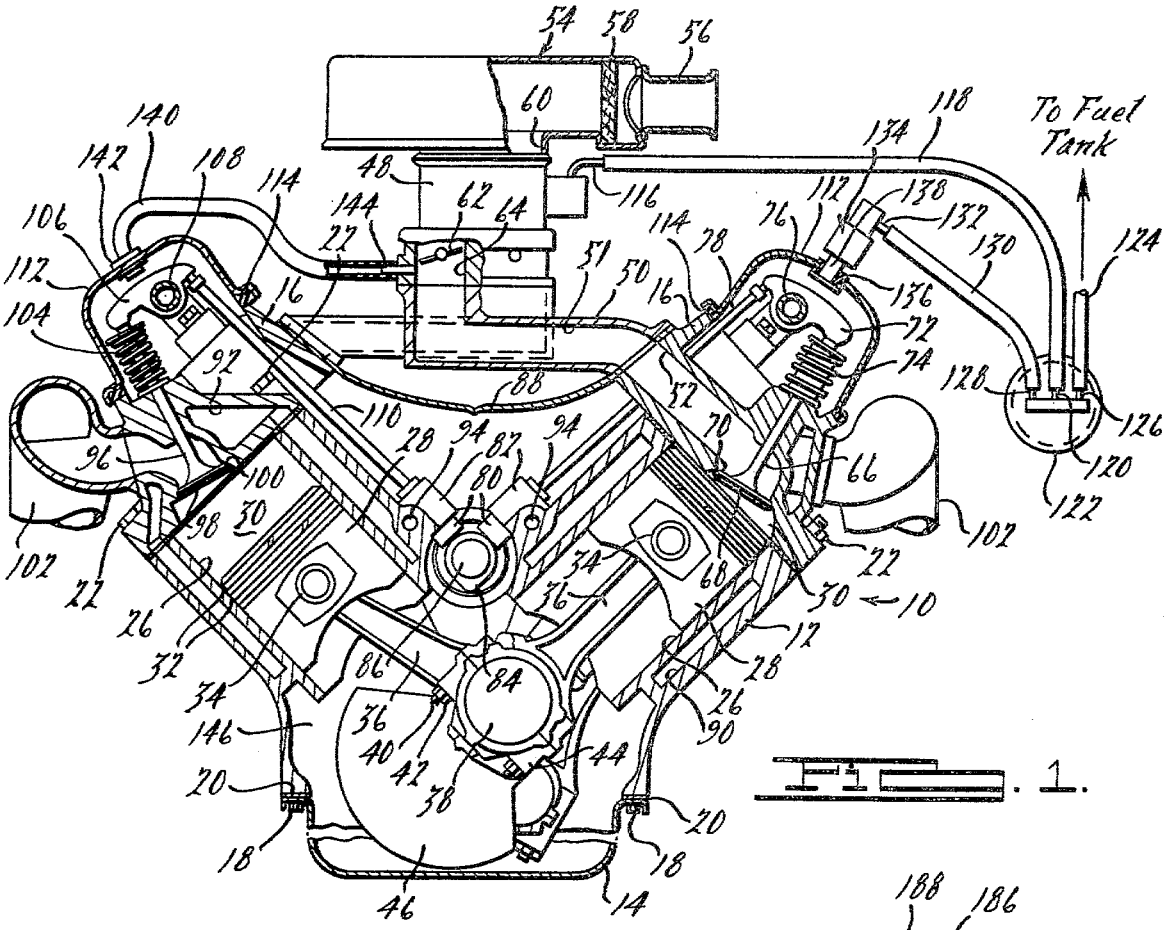
FIG. 1 is a sectioned end view of an automobile engine including the subject purging system.

In FIG. 1 of the drawings, an internal combustion engine 10 is illustrated including an engine body assembly 12, an oil pan member 14 and cylinder heads 16. The oil pan 14 is fastened to the lower portion of the block 12 by fasteners 18 and includes a gasket 20 therebetween to prevent oil leakage. Likewise, the cylinder heads 16 are fastened to the block 12 by fasteners 22. The block 12 has cylinder bores 26 therein (two of which are illustrated). The engine in FIG. 1 could be a V-6 or V-8 in configuration and the purge system is applicable to a 6 cylinder in-line or 4 cylinder in-line engine. Within the cylinder bores 26, pistons 28 are mounted for reciprocal movement. In a known manner, a combustion charge in combustion chambers 30 is substantially sealed by a plurality of piston rings 32. The pistons are pivotally fastened by wrist pins 34 to the upper ends of connecting rods 36. At lower ends, the connecting rods 36 are attached about a crankshaft 38. The form of attachment is by conventional bolt and nut fasteners 40,42 which secures bearing caps 44 to the connecting rod 36 and around the crankshaft journal. Visible in FIG. 1 are counterbalance weights 46 of the crankshaft.

The engine air-fuel charge is established by carburetor 48 mounted to an intake manifold 50. The intake manifold 50 is attached to the cylinder head 16 with passages 51 in alignment with intake passages 52 therein. Clean air for induction into the engine is provided by an air cleaner assembly 54. The air first passes through a snorkel tube 56 and then hence through an annularly shaped filter member 58 before flowing downward through an opening 60 into the carburetor 48. A pivotal throttle blade 62 in the carburetor passage 64 regulates the volumetric flow of air through the carburetor and hence into the passages 51 and 52. As can be seen in the rightward cylinder head 16 in FIG. 1, the mixture passes into the combustion chamber 30 past a downwardly movable valve member 66 in the conventional manner. Valve 66 includes a valve head portion 68 which engages an annular valve seat 70. At the other end of the valve 66, a rocker arm 72 engages the valve. A spring 74 normally urges the valve upward to the closed position shown in FIG. 1. The rocker arm 72 pivots clockwise about a shaft 76 in response to an upward movement of push rod 78. The lower end of the push rod 78 engages a valve lash adjuster 80 which is reciprocal within a bore in tappet boss 82. The valve lash adjuster 80 has an end face which is contacted by the lobes 84 of a camshaft 86. Adjuster may be of conventional design and utilizes hydraulic pressure in its lash take-up action.

Visible in FIG. 1 immediately above the camshaft 86 is a tappet cover member 88 which shields the manifold 50 from oil splash and heat of the engine as well as prevents entry of dirt and water to the crankcase. Also of note in FIG. 1 are water passages 90 in the block 12 for cooling the engine. Also water passages 92 extend through the cylinder heads 16. Adjacent the valve lash adjusters 80, oil gallery passages 94 serve to provide oil to the adjusters as well as transmit oil to the camshaft bearings.

During the exhaust portion of the piston movement, exhaust gases from the combustion chamber 30 pass by an exhaust valve 96 having a valve end 98 which contacts valve seat 100. The exhaust gases to flow into an exhaust manifold 102 and hence to a conventional exhaust system on the vehicle (not shown). The exhaust valve 96 is engaged by a spring 104 which normally maintains the valve in the upward closed position shown in FIG. 1. The valve 96 is moved downward to a more open position by counterclockwise movement of a rocker arm 106 which pivots about rocker shaft 108. A push rod 110 is actuated by valve lash adjuster 80 and the camshaft 86 to pivot the rocker arm 106 and move the valve 96 downward to a more open position. Also note the valve covers 112 which are mounted on the cylinder heads 16. Gaskets 114 prevent leakage of oil between covers 112 and heads 16.

During engine operation, fuel is supplied to the carburetor 48 where it collects in a fuel bowl therein. In order to decrease the escape of vapor from the fuel bowl, a carburetor outlet fitting 116 communicates with the upper portion of the fuel bowl. Fitting 116 is connected by flexible conduit 118 to an inlet 120 of a vapor storage canister 122. The vapor storage canister is a hollow housing member holding a quantity of activated charcoal, as is conventional. In addition, a second flexible conduit 124 attaches to another inlet fitting 126 and communicates the upper portion of the fuel tank with the storage canister 122. An outlet fitting 128 of the canister 122 is connected by flexible conduit 130 to an inlet fitting 132 of an automatic air valving device 134 which is supported by the rightward valve cover 112 in FIG. 1. A gasket member 136 encircles a lower outlet portion 138 of the valve 134. The leftward valve cover 112 receives a conduit 140 which extends through a gasket member 142 at one end. The other end of conduit 140 is attached to an inlet 144 opening to the throat 64 of the carburetor 48 downstream from the throttle blade 62. Thus a continuous evacuating action is produced on the interior of the engine and the portion defined by valve cover 112. By means of conduit 140, hydrocarbon vapors are evacuated from the interior of the engine. Air is also withdrawn from the engine interior and replaced by a flow through the valving device 134. The air so supplied is drawn through the canister 122 which has a conventional structure and includes an air inlet at the end opposite outlet 128. This enables air to flow through the activated charcoal and pick-up stored hydrocarbons therein. Communication is formed between the interior of valve covers 112 and the crankcase 146 by vertical oil return channels (not shown) which extend adjacent cylinder bores of the engine.

As previously mentioned, it is desirable to provide air flow for canister purging sufficient to maintain the canister's fuel absorbing characteristic. However, during engine idling, it is desirable to substantially reduce the air flow to the manifold so as not to interfere with engine operation. In FIG. 7, a plot of air flow through the valving device versus manifold vacuum is shown. Four common engine conditions are labelled as follows: wide open throttle, cruise, idle and deceleration. Note that at wide open throttle the purge flow is substantially zero. This is partially because the manifold vacuum pressure is very low under this engine condition and therefore little air flow is induced to pass through the engine. During engine cruise conditions, most of the purging action takes place and thus substantial air flow is provided. During engine idle, the air flow through the crankcase and into the intake manifold is substantially reduced by the valving device 134. Resultantly engine idle operation is enhanced. During engine decelerations, it is desirable to provide great air flow through the canister 122 and the crankcase 146. Since the throttle blade 62 of the carburetor 48 is then substantially in a closed position and the engine is no longer driving the vehicle, any resultant alteration of the air-fuel ratio by this large flow of air into the intake manifold is not detrimental.

The valve device which controls the flow of purge air through crankcase 146 and into the intake manifold 50 is detailed in FIGS. 2–6. The valve device 134 includes a housing 150 which may be of molded plastic material. Housing 150 defines an interior space 152 and has a lower portion 138 forming an outlet with passage 156 therethrough. The outlet is adapted to fit snugly through rubber grommet 136 shown in FIG. 1 and includes a radially outwardly projecting lip portion 158 to maintain the valve 134 in position. At the upper end of valve 134, inlet portion 132 is provided defining a passage 162. The inlet is adapted to engage the flexible conduit 130 shown in FIG. 1 and a radially outwardly extending lip portion 164 maintain a desired sealed connection with the conduit. Extending across the interior 152 is an apertured wall defining a circular flow opening 166 communicating space 152 with a second space 168.

A specifically configured valving member 170 extends through the opening 166 and normally extends its upper portion in chamber 168 and its lower portion in the chamber 152. A base portion of member 170 includes a radially outwardly extending lip portion 174. A plurality of openings 176 extend therethrough. The openings 176 are to better permit flow past the member 172 when the valve member 170 is in the fully opened position shown in FIG. 5 in which spring 178 is compressed. The position of member 170 is maintained by the balance between forces caused by vacuum induced air flow acting on the member 170 and the force of spring 178.

Figure 2:
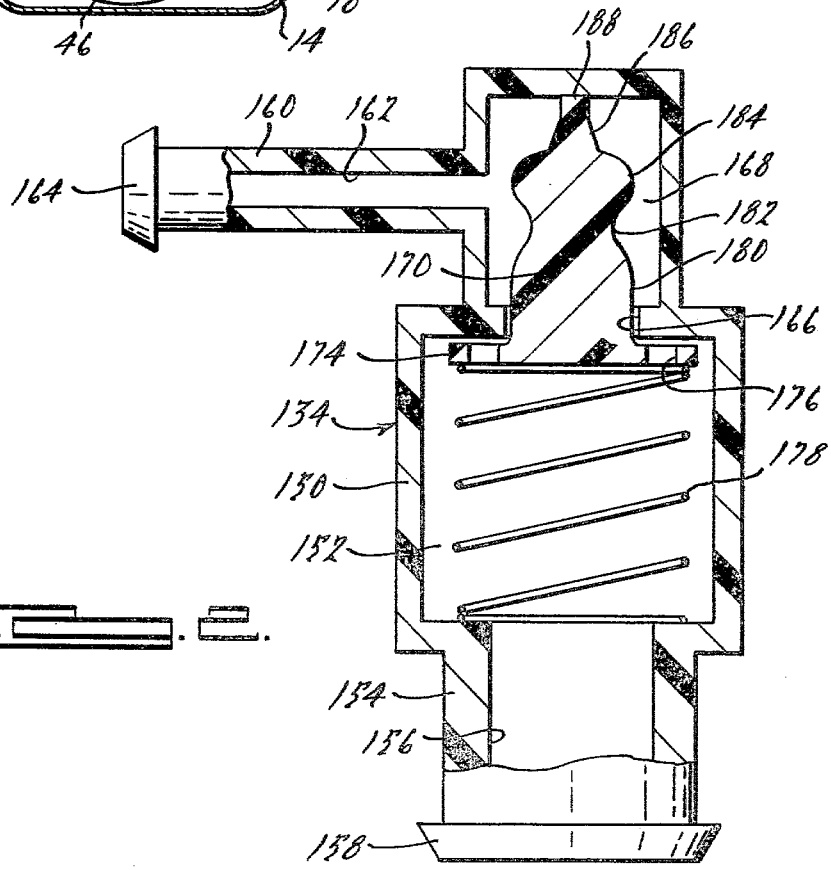

In FIG. 2 the neutral position assumed by valve 170 corresponds to a wide open throttle mode. Throttle plate 62 is in its fully opened during this W.O.T. engine mode and maximum power and acceleration is expected. In FIG. 3, the more opened position of member 170 corresponds to a cruise mode. In FIG. 4, the position of the member 170 corresponding to an engine idle mode and in FIG. 5, the position of the member 170 corresponds to a deceleration engine mode.

It should be noted that the upper portion of the valve member 170 is configured with alternating large and small dimensioned portions. Specifically, a large diameter portion 180 is placed adjacent the base and practically fills the flow opening 166. When the valve member 170 is located as in FIG. 2 so as to place portion 180 in opening 166 no substantial air flow exists. This corresponds to the wide open throttle condition when the manifold vacuum is very weak. Portion 180 is a substantially smaller diameter portion 182. When located in the flow opening 166 as shown in FIG. 3 a substantial air flow passes through the valving device 134. This position corresponds to a cruise mode of engine operation and accounts for a large proportion of the canister purging since the engine normally operates under these conditions most of the time. A larger diameter portion 184 is located next to portion 182 which when placed across the opening 166 as shown in FIG. 4 produces a decreased flow of air into the intake manifold 50. This positioning corresponds to an idle mode of the engine. As can be seen in FIG. 7, there is some purge flow through the engine during idle. Even though the annular space between portion 184 and the flow opening 166 is small there is a very strong inducement for the flow therebetween due to a strong vacuum produced at idle. At the upper end of the valve member 170 is located a small diameter portion 186. When extending across opening 166 it allows a large flow of purge air into the intake manifold 50. This corresponds to the engine deceleration mode of operation during which a large flow does not adversely affect the operation of the engine since the vehicle is then driving the engine rather than the engine driving the vehicle. The very uppermost end portion 188 of the valve member 170 acts as a stop to limit extreme upward movement of the valve member 170 as shown in FIG. 2. This also produces a very small clearance between the valve member 170 and the transverse wall forming opening 166. The openings 176 in portion 174 facilitate a minimum flow through this clearance.

A number of modifications of the aforedescribed system readily come to mind. The basic inventive concept of a pressure responsive valve control to purge the canister at varying rates is still applicable. Particularly, a relocation of the control valve 134 may be made from the righthand position in FIG. 1 to a lefthand location. In this new position, the valve receives fluid from the crankcase space 146 and discharges it to the line 140 for flow into carburetor 48. Of course, in this new location, the fluid would enter from the bottom end while exiting from the top end. Rather than utilizing the spring 178 between the valving member 170 and the bottom end as in FIG. 2, the valve would be modified by placing the spring 178 between the valve member 170 and the upper end of housing 150. In this arrangement, the spring would encircle the contoured portions 180–186. A pin extending across the lower opening 156 would prevent movement of the valve 170 therein. The aforedescribed arrangement would provide a location for a one-way check valve at the righward location between the canister 122 and the interior of valve cover 112. The check valve could be of the common "umbrella" design and would be mounted "upside down" at the bottom 154 of valve housing 150. This would permit only flow from the canister to the crankcase interior and prevent flow back into the canister under any pressure circumstance.

Although the drawings illustrate only one embodiment of the invention, it should be readily apparent that modifications can be made to the apparatus and system and still fall within the scope of the invention as defined by the following claims:

I claim:

1. In combination with an engine having an interior crankcase space, suction producing air induction means having a movable throttle and hydrocarbon vapor storage means having an inlet to atmosphere and an outlet, a purge system and apparatus to withdraw hydrocarbon vapors from the engine interior space and the vapor storage means for passage into the air induction means comprising: first passage means communicating the air induction means with the engine interior space thereby producing a continuous evacuating action when the engine is operative, second passage means selectively communicating with engine interior space with the outlet of the vapor storage means including a pressure responsive valving control with multifunction flow capabilities to regulate air flow through the storage means, the flow through the engine interior space and storage means into the air induction means characterized by substantially zero flow under a wide open throttle engine condition, a relatively low rate of flow under idle engine conditions, a greater rate of flow under part throttle cruise conditions and a maximum rate of flow under closed throttle deceleration engine conditions.

2. In combination with an engine having an interior crankcase space, suction producing air induction means having a movable throttle and hydrocarbon vapor storage means having an inlet to atmosphere and an outlet, a purge system and apparatus to withdraw hydrocarbon vapors from the engine interior space and the vapor storage means for passage into the air induction means comprising: first passage means communicating the air induction means with the engine interior space thereby producing a continuous evacuating action when the engine is operative, second passage means selectively communicating the engine interior space with the outlet of the vapor storage means including a pressure responsive valving control with multifunction flow capabilities to regulate air flow through the storage means, the flow through the engine interior space and the storage means into the air induction means characterized by substantially zero flow under a wide open throttle engine condition, a relatively low rate of flow under idle engine conditions, a greater rate of flow under part throttle cruise conditions and a maximum rate of flow under closed throttle deceleration engine conditions, the pressure responsive valving control including a hollow housing defining a flow passage therethrough with an apertured wall therein extending between the inlet and outlet and defining a flow opening, a movable valving element in the housing having an elongated and particularly contoured portion extending through the flow opening hus occupying portions thereof for controlling flow whereby each contour corresponds to one of the particularly characterized flow condition and the position of the elongated portion relative to the flow opening is established in correspondence with the vacuum pressure level in the engine interior space produced by the suction of the air induction means.

3. The combination set forth in claim 2 and including yieldable spring means urging the movable valving element toward the zero flow position whereby increasing vacuums in the engine interior space sequentially forces the spring and the valving element into the positions corresponding to the characterized flow conditions.

4. The combination set forth in claim 2 in which the flow opening is circular and the valving element has circular contours in cross-section of varying diameters to produce a variable flow passage in cooperation with the flow opening, a first circular contour of the valving element corresponding to the substantially zero flow condition and having a diameter only sufficiently less than the circular flow opening to permit axial movements of the element, a second circular contour integral with the first and corresponding to the greater cruise flow rate resulting from a reduced diameter contour, a third circular contour integral with the second and corresponding to the low idle flow rate produced by a contour with a diameter dimensioned between the diameters of the first and second portions, a fourth circular contour integral with the third and corresponding to the maximum deceleration flow rate produced by a contour with a diameter range less than the diameter of the second portion.

5. In a vehicle having an engine, a pressure responsive valving control for regulating air flow between a hydrocarbon storage means and an engine air induction means, comprising: a hollow housing defining a flow passage therethrough including inlet and an outlet passage means for connection respectively to the hydrocarbon storage means and the engine, an apertured wall extending across the flow passage and defining a flow control opening therethrough between the inlet and outlet, a valving element in the housing with an elongated portion extending through the flow control opening, yieldable means responsive to pressures produced by the engine air induction means and operably attached to the valving element to permit axial reciprocation of the elongated portion in the flow control opening, the elongated portion having a first contour thereon with a cross-sectional area only sufficiently less than the area of the flow control opening to permit reciprocation, a second contour integral with the first and having a cross-sectional area substantially less than the first portion, a third contour integral with the second and having a cross-sectional area between the areas of the first and second contours and a fourth contour integral with the third and having a cross-sectional area less than the area of the second contour whereby as the first, second, third and fourth contours are sequentially moved into alignment across the flow control opening in response to pressure changes and resultantly the flow rate varies from zero to a greater rate then to a reduced rate and finally to a maximum rate.

* * * * *